United States Patent [19]

Ponomarev et al.

[11] 4,212,914

[45] Jul. 15, 1980

[54] ELECTROINSULATING MATERIAL

[76] Inventors: Leonty T. Ponomarev; Nina V. Ponomareva, both of Ozerny pereulok, 2, kv. 9; Sergei V. Vasiliev, ulitsa Stoikosti, 2/11, kv. 93, all of Leningrad; Olga V. Maximikhina, Proletarskaya ulitsa, 47, kv. 2, Petrokrepost Leningradskoi; Nina M. Golopolosova, ulitsa Sovetskaya, 48, Tosno Leningradskoi; Ljudmila I. Belkina, ulitsa Kalyaeva, 14, kv. 25, Leningrad, all of U.S.S.R.

[21] Appl. No.: 908,786

[22] Filed: May 23, 1978

Related U.S. Application Data

[63] Continuation of Ser. No. 522,250, Nov. 8, 1974, abandoned.

[51] Int. Cl.[2] ..... H01B 3/04; H01B 3/44

[52] U.S. Cl. ..... 428/268; 252/63.2; 252/63.5; 252/66; 260/38; 260/39 R; 260/42.27; 428/324; 428/413; 428/421; 428/423.7; 428/474; 428/483; 428/528

[58] Field of Search ..... 260/42.27, 38, 39 R; 428/268, 324, 413, 421, 425, 474, 483, 528; 252/63.2, 63.5, 66

[56] References Cited

U.S. PATENT DOCUMENTS

| | | | |
|---|---|---|---|
| 3,520,845 | 7/1970 | McKeown et al. | 260/42.27 |
| 3,655,565 | 3/1972 | McDonald | 260/42.27 |
| 3,864,228 | 2/1975 | Rossetti | 260/42.27 |

*Primary Examiner*—James H. Derrington
*Attorney, Agent, or Firm*—Haseltine, Lake & Waters

[57] ABSTRACT

The electroinsulating material of the present invention contains a fluorine rubber, low-molecular weight sticky resin, cross-linking agents, particles of a mica-containing material, and a mineral filler.

This material features high corona resistance, elasticity, heat resistance, and incombustibility.

8 Claims, No Drawings

ELECTROINSULATING MATERIAL

CROSS-RELATED APPLICATION

This Application is a continuation of Ser. No. 522,250 filed Nov. 8, 1974, now abandoned.

The present invention relates to electroinsulating materials. The invention is useful in the production of turn and frame insulation of electric windings of, for example, electric machines, coils, wires, cables, transformers and other electro- and radio- components and articles.

Known in the art are electroinsulating materials comprising a layer of sliced mica bonded to a substrate such as paper, silk, glass fabric (such materials are referred to as mica tapes) as well as micanite paper bonded to silk, paper, glass fabric (such materials are referred to as glass-micanite tapes). These materials, however, cannot adequately meet the requirements of modern industry such as heavy electric engineering, where coil windings and bar windings of a complicated geometric configuration are used Most grave disadvantages of insulations based on mica tapes and glass-micanite tapes reside in the lack of elasticity, low heat resistance, insufficient corona resistance, and combustibility. Mica tape and glass-micanite tapes are not uniform enough as to their thickness, they are not flexible and show poor processability in the insulation of coil and bar windings by way of a multilayered application of an insulating material. The thus-insulated coils feature insufficient elasticity and cannot be put into stator grooves while applying substantial bending strains.

The prior art electroinsulating materials based on fluoro-organic rubbers, fillers and cross-linking agents do not possess sufficient electric strength and corona resistance. The materials are not adequately strong against punching and are easily damaged when notched, especially in the thin layers that are encountered in the insulation of stator windings of electric machines by means of said insulating materials.

It is an object of the present invention to overcome the disadvantages mentioned above.

It thus is an object of the present invention to provide an electroinsulating material that would possess a high corona resistance.

It is another object of the present invention to provide an electroinsulating material which would have improved heat resistance, elasticity, and incombustibility.

These objects are accomplished by an electroinsulating material that incorporates fluorine rubber, cross-linking agents and a filler, in accordance with the present invention which additionally contains a low-molecular weight sticky resin and particles of a mica-containing material uniformly distributed throughout the entire volume of the electroinsulating material.

The electroinsulating material according to the present invention features a high corona resistance elasticity, heat resistance and incombustibility.

The electroinsulating material should preferably incorporate: 20 to 87% by weight of fluorine rubber, 10 to 60% by weight of mica-containing materials, 1 to 10% by weight of a resin, 0.1 to 10% by weight of cross-linking agents, the filler constituting the balance.

Due to the fact that the electroinsulating material of the present invention incorporates the components in the proportions given above, it features exclusively high corona-resistance, elasticity, and heat resistance.

An embodiment of the present invention contemplates the use of a synthetic rubber additionally incorporated in an amount of at most 30% by weight.

Due to the additional content of a synthetic rubber, it is possible to impart thermosetting properties to the electroinsulating material.

Further objects and advantages of the present invention will now become more fully apparent from the following detailed description of the electroinsulating material.

The electroinsulating material according to the present invention incorporates a fluorine rubber which is used as a binder.

Said fluorine rubber—a copolymer based on fluoroolefins—includes the following compounds: a copolymer of trifluorochloroethylene with vinylidene fluoride $$\left[CF_2-CFCL\right]_n \left[CH_2-CF_2\right]_m$$

or a copolymer of hexafluoropropylene with vinylidene fluoride $$\left[CF_2-\underset{}{\overset{CF_3}{\overset{|}{C}}}F\right]_n \left[CH_2-CF_2\right]_m;$$

units n and m may be varied in an altogether arbitrary alternation order. Molecular weight may be over 100,000.

Other fluoro-organic products, some of which contain oxygen, may be present in the copolymers. Strength and polarity of fluorine-carbon bonds imparts to these rubbers an increased resistance against thermal aging, while a high fluorine content results in chemical inactivity and incombustibility. Chlorine provides an enhanced adherence to mica-containing materials incorporated, according to the present invention, in the electroinsulating material, while a $CH_2$ unit results in flexibility of a polymer chain and ability to cross-link. The fluorine rubbers used in the present invention have a Mooney viscosity ranging of from 30 to 150.

In order to improve processability and compatibility with mica-containing materials, the electroinsulating material of the present invention incorporates, in addition to the fluorine rubber, a low-molecular weight sticky resin such as an epoxy diane resin of the formula:

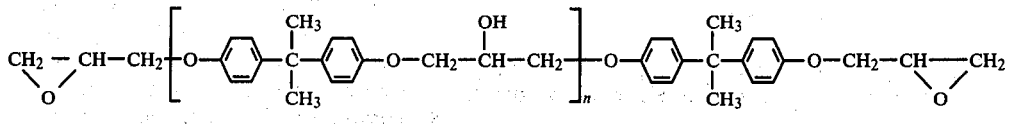

with a molecular weight ranging from 600 to 1,500 which comprises a sirup-like liquid with a color ranging from light-yellow to brown.

The present invention contemplates the possibility of using low-weight resins such as a silicone resin of a polymethylphenylvinylhydrosiloxane type corresponding to the formula:

$$\{(-C_6H_5SiO_{1.5})(CH_3HSiO)(CH_3CH_2{=}CHSiO)(CH_3C_6H_5SiO)\}_n;$$

with a molecular weight ranging from 300 to 600 and a viscosity (as measured by means ranging Ford's funnel) of from 1 to 10 minutes, as well as urea-formaldehyde resins, phenol-formaldehyde resins, amino-phenol resins, malamine-formaldehyde resins, urethane resins, xylenol resins, coumarone resins, and indene-coumarone resins.

To impart improved dielectric properties and corona resistance to the electroinsulating material, particles of muscovite mica of the composition $KH_2Al_2Si_3O_{12}$, phlogopite of the composition $KH_3Mg_3AlSi_3O_{12}$ or both are uniformly distributed throughout the entire volume of the material. These particles of a mica-containing material, uniformly distributed in the electroinsulating material, result in an increased resistance against punching and notching, even in thin layers. The mica-containing materials in the form of small particles with a thickness ranging from 10 to 1$\mu$ are incorporated into the sticky composition consisting of the fluorine rubber mentioned above and low molecular weight sticky resin. Such uniformly distributed particles of a mica-containing material impart, to each local spot of the electroinsulating material, a high corona resistance as well as resistance against punching and insensitiveness to notching.

To ensure a more uniform distribution of the mica particles within the entire volume of the electroinsulating material, the latter contains also a mineral filler such as white black, zinc oxide, talc, kaolin, chalk, diatomite, marshallite, magnesia, barite, gypsum, lithopone, pumice, magnesia usta, titanium white, zinc sulphide.

The electroinsulating material of the present invention contains cross-linking agents which ensure cross-linking of linear polymeric molecules of the fluorine rubber to produce a three-dimensional reticulated structure; the cross-linking is effected mainly at the units $CH_2$ or CFCl.

The cross-linking agents may be, for example, bis-(furfurylidene)-hexamethylene diimine of the formula:

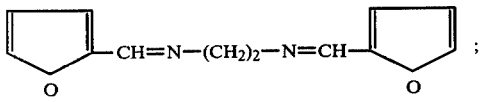

;

copper salicylalimine of the formula:

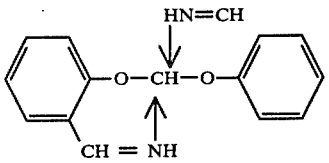

;

benzoyl peroxide, dicumyl peroxide, polyethylenepolyamine, hexamethylenediamine, or triethanolamine.

Stability of the electroinsulating material properties is achieved by heating at a temperature within the range of from 80° to 200° C. for a period of from 1 to 10 hours whereby linear polymeric molecules of the fluorine rubber are transformed into a reticulated structure, the cross-linking is effected mainly at the units $CH_2$ and CFCl. This is facilitated by the presence of the cross-linking agents mentioned above. In accordance with the present invention, a minimal amount of the fluorine rubber which ensures a complete coating of the mica-containing material particles and the formation of a solid electroinsulation composition is of about 20% by weight.

An embodiment of the material according to the present invention incorporates the components mentioned above in the amounts as follows (percent by weight):

| | |
|---|---|
| fluorine rubber | 20 |
| low-molecular weight resins | 10 |
| mica-containing materials | 60 |
| cross-linking agents | 0.1 |
| mineral filler | the balance. |

The fluorine rubber content below 20% by weight results in a substantially impaired electric strength, lack of elasticity, and considerably reduced properties of the electroinsulating material under the action of humidity.

The maximal content of the fluorine rubber is, in accordance with the present invention, 87% by weight; the following composition of the material according to present invention corresponds to this fluorine rubber content (percent by weight):

| | |
|---|---|
| fluorine rubber | 87 |
| low-molecular weight resins | 1 |
| mica-containing materials | 10 |
| cross-linking agents | 1 |
| mineral filler | the balance. |

The mica-containing material should amount to at least 10% by weight, since, as has been found by the inventors, only this particular amount ensures corona resistance of the electroinsulating material and its resistance against punching and notching.

However, the mica-containing material content over 60% by weight results in an insufficient coating of the mica particles with the fluorine rubber and the formation of air inclusions in the electroinsulating material, whereby corona-resistance, electric strength, elasticity, and moisture resistance of said material become substantially impaired.

The minimal amount of said low-molecular weight resins is selected to be 1% by weight, since this amount is sufficient to ensure a uniform distribution of the mica particles throughout the entire volume of the electroinsulating material according to the present invention.

The minimal amount of the cross-linking agents according to the present invention is 0.1% by weight in view of the fact that a lesser amount does not ensure the formation of a reticulated structure along the units $CH_2$ and CFCl of the fluorine rubber employed.

A content of cross-linking agents above 10% by weight results in the formation of a too rigid reticulated structure whereby elasticity and heat-resistance of the electroinsulating material become substantially reduced.

Additionally, the composition of the electroinsulating material contains according to the present invention, a

| | |
|---|---|
| synthetic divinyl rubber | 100 |
| escapone resin of the butadiene oligomers type | 100 |
| aviation oil | 20 |
| linseed oil factice | |
| lead rosinate | 6 |
| phenyl-β-naphthylamine (Neozone-D) | 6 |
| kerosene | 400 |

After curing the surface of the glass fabric becomes smooth and even. The total thickness of the glass-escapone varnished fabric is 100 mcm. Thereafter, the electroinsulating material of the present invention is applied onto both sides of the prepared substrate to a thickness of 200–250 mcm. Then its electric strength is as follows:

| | |
|---|---|
| after heating at 200° C. for 50 hours and rolling with a 2 kg roll | 35 kV/mm |
| after water-treatment for 24 hours | 25 kV/mm. |

The material is incombustible, corona resistant, and has a heat resistance corresponding to class F, i.e. it retains its properties at temperature of 155° C. for a long period.

Due to its elasticity, the material has an adequate processability and is useful for turn and frame insulation of windings of electric machines and other electrotechnical components.

Still better physico-mechanical and dielectric properties can be achieved if a glass fabric with a thickness of 4.0 mcm is pre-coated with a layer of escapone varnish of the following composition (parts by weight):

| | |
|---|---|
| synthetic divinyl rubber | 100 |
| escapone resin of the butadiene oligomers type | 100 |
| aerooil | 20 |
| linseed oil factice | |
| lead rosinate | 6 |
| phenyl-β-napthylamine (Neozone-D) | 6 |
| kerosene | 400 |

After curing the surface of the glass fabric is smooth and even. The total thickness of the glass-escapone varnished fabric is 100 mcm. Thereafter, the electroinsulating material of the present invention is applied onto both sides of the prepared substrate to a thickness of 200–250 mcm.

Due to the continuous layer of the electroinsulating material according to the present invention applied to the surface of the glass-escapone varnished fabric, it becomes incombustible and heat-resistant. Since this continuous layer hinders penetration of air oxygen to the varnish layer, the latter retains its elasticity at elevated temperatures and its heat resistance becomes significantly improved. The material acquires greater corona resistance. The glass-escapone varnished fabric with the electroinsulating material of the present invention applied onto both sides has the following characteristics:

| | |
|---|---|
| Thickness of the material, mm | 0.25 |
| Water absorption for 24 hours, % | below 1 |
| Specific volume resistance, ohm.cm: | |
| in the initial condition, | $10^{15}$ |

-continued

| | |
|---|---|
| after 24 hours in water | $10^{14}$ |
| after 20 days in hygrostat | $10^{14}$ |
| after 5 days of aging at 200° C. and 24 hours in water | $10^{14}$ |
| Electric strength, kV/mm: | |
| in the initial condition | 50 |
| after 24 hours in water | 45 |
| after 20 days in hygrostat | 45 |
| after 18 hours of aging at 200° C. inflection and rolling | 40 |
| Tensile strength of a 15 mm wide tape kg | 15 kg. |

Still further increase in dielectric properties, especially corona resistance, is achieved by applying the electroinsulating material of the present invention onto a substrate comprising a polyethyleneterephthalate film, the polymer corresponding to the formula

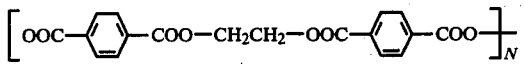

Onto both sides of a polyethyleneterephthalate film of 20 mcm thickness a layer of the electroinsulating material of the present invention is applied to a thickness of 100 mcm. The material produced in this manner has the following electroinsulating characteristics:

| | |
|---|---|
| Electric strength, kV/mm: | |
| in the initial condition at 20° C. | 70–80 |
| at 130° C. | 62–70 |
| after humidification for 30 days at a 96% relative humidity and 20° C. | 45–50 |
| Specific volume resistance, ohm.cm.: | |
| in the initial condition | $10^{15}$ |
| at 130° C. | $10^{13}$ |
| after water treatment for 30 days | $10^{14}$ |

The material is incombustible, corona resistant and its heat resistance corresponds, to the "F" class (155° C.).

Increased heat resistance corresponding to the "H" class (180° C.) is obtained by using, as a substrate, a polyimide film. Molecular structure of a polyimide consists of alternating units of a tetrabasic acid and diamines:

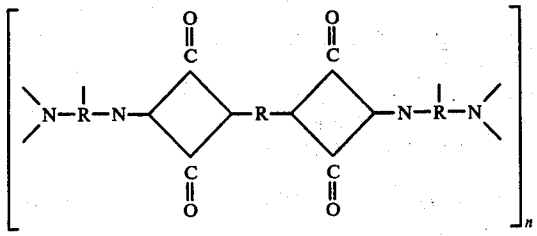

Pyromellitic acid is used as the tetrabasic acid while diaminodiphenyl methane is used as the diamine. The film is produced by casting a solution of polypyromellitamidoacid and dimethylformamide onto an endless tape.

When uniformly applied onto both sides of a 40 mcm polyimide film to a thickness of 100 mcm, the electroinsulating material of the present invention gives the resultant material the following physico-mechanical and dielectric properties:

synthetic rubber such as with divinyl groups e.g. polybutadiene hereafter termed divinyl rubber, divinylstyrene rubber or divinylstyrenecarboxylate rubber which impart some useful properties, in particular, thermosetting properties to said electroinsulating material. In the case of divinyl synthetic rubber the following scheme of transformation of linear polymer molecules due to cross-linking at the sites of double bonds and the addition of oxygen at these sites has been established:

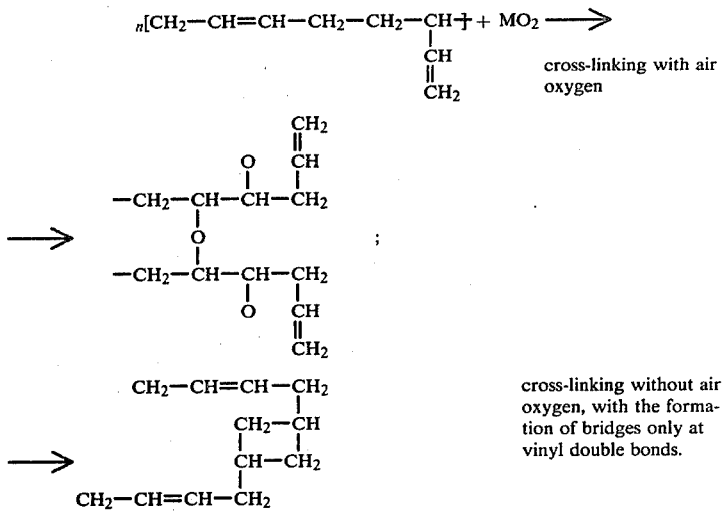

The electroinsulating material of the present invention additionally contains a synthetic rubber with the maximal content not exceeding 30% by weight, since an increased content above 30% by weight results in a substantially reduced heat resistance and increased combustibility of the material.

The following composition corresponds to this case (amounts of the components expressed in percent by weight):

| | |
|---|---|
| fluorine rubber | 30 |
| low-molecular resin | 3 |
| cross-linking agents | 0.1 |
| synthetic rubber | 30 |
| mica-containing material | 30 |
| mineral filler | the balance. |

As has been mentioned previously, a synthetic rubber such as divinyl rubber forms a reticulated structure directly at the sites of vinyl double bonds, while cross-links are obtained due to oxygen bridges at the sites of double bonds in the main chain.

The resulting three-dimensional structure imparts thermosetting character to the electroinsulating material and improves its physico-mechanical and dielectric properties.

The electroinsulating material of the present invention may be applied to the surface of electrotechnical steel, copper wires or other electrotechnical components, units, and articles to produce a turn and frame insulation.

The insulation layer is applied by conventional techniques by dissolving the electroinsulating material in an organic solvent, followed by casting, spraying or brushing onto the surfaces to be insulated. Any suitable solvents such as acetone may be used for the organic solvent. When acetone is used the insulation layer is air-dried.

The applied insulation layer acquires the stability of its electroinsulating properties after heating within a temperature range from 80° to 200° C. Thereafter, its electric strength is 60 kV/mm, specific volume resistance is about $10^{15}$ ohm.cm, dielectric loss angle at the frequency of 50 cycles is 0.2%. The material is incombustible, corona-resistant moisture- and water- resistant.

The electroinsulating material of the present invention may be applied to different substrates. When applied onto a glass fabric, it gives a composite mica-varnished glass fabric which possesses the high elasticity, incombustibility and ability to retain good electroinsulating properties at temperatures up to 250° C. For example, onto a glass fabric with a thickness of 40 mcm a calibrated layer of the electroinsulating material is applied onto both sides to a thickness of 0.15 mm. The resulting composite material, i.e. mica-varnished glass fabric features the following physico-mechanical and dielectric properties:

| | |
|---|---|
| thickness | 0.15 mm |
| tensile strength of a tape of 15 mm width is | 15 kg |
| electric strength in the original state | 40 kV/mm |
| after inflection and rolling with a 2 kg roller | 38 kV/mm |
| after heating at 200° C. for 50 hours and rolling with a 2 kg roll | 35 kV/mm |
| after water-treatment for 24 hours | 25 kV/mm. |

The material is incombustible, corona-resistant, and has a heat resistance corresponding to class F, i.e. it retains its proper ties at a temperature of 155° C. for a long period.

Due to its elasticity, the material has an adequate processability and is useful for turn and frame insulation of windings of electric machines and other electrotechnical components.

Still better physico-mechanical and dielectric properties can be achieved if a glass fabric with a thickness of 40 mcm is pre-coated with a layer of escapone varnish of the following composition (parts by weight):

| | |
|---|---|
| Thickness, mm | 0.1 |
| Tensile strength of a 15 mm wide tape, kg | 20 |
| Heat-resistance "H" class (180° C.) | |
| The material is incombustible and corona-resistant. | |
| Electric strength, kV/mm: | |
| in the initial condition at 20° C. | 80 |
| at 180° C. | 65 |
| after humidification at a 96% relative humidity and 20° C. for 30 days | 50 |
| Specific volume resistance, ohm.cm.: | |
| in the initial condition | $10^{15}$ |
| at 180° C. | $10^{13}$ |
| after treatment with water for 30 days | $10^{14}$ |

The material retains its elasticity after thermal aging at 250° C. for 100 hours.

It is advantageous to apply, onto the above-mentioned roll materials, a sticky adhesive layer consisting of an epoxy resin and a curing agent such as polyethylenepolyamide; epoxy resin and an anhydride curing agent; polyester resin with curing agents; polyurethane resins, phenol-formaldehyde resins, or melamine-formalde melamino-formaldehyde adhesive resins. Adhesive electroinsulating tapes are intended for insulation of turn and frame windings of stators, coils, wires, transformers, motors and other electrotechnical components, units and articles.

Adhesive elastic tapes are easily applied manually or by means of special devices onto windings of electric machines of a complicated shape; adhesive tapes have calibrated thicknesses and their uniform application under a uniform tension results in a uniform turn and frame insulation with minimal thickness variations. The sticky layer of the tape ensures sufficiently monolithic adherence of one layer to another. Gas inclusions are eliminated mainly due to displacement of the sticky mobile layer towards the external surface. Such character of the process is evidenced by the manufacture of packs and bars of a stator winding for turbo-hydrogenerators. Insulated bars have an even surface. The curing of sticky layers of the frame insulation is effected within a temperature range of from 100° to 160° C. for a period of from 2 to 15 hours.

The properties of a frame electric insulation based on polyethyleneterephthalate film having applied layers of the electroinsulating material of the present invention and an adhesive layer were tested on models of 1000×28×5 mm size with the frame insulation thickness on one side being 1.00±0.05 mm. The lasting influence of an electric field upon the frame insulation made of any conventional electroinsulating material results in a reduced electric strength and, as a result, a breakdown, whereby an electric machine or other device becomes inoperative.

The reduced lifetime of a frame high-voltage insulation under the influence of an electric field /E/ depending on the influence duration /$\tau$/ may be expressed by means of the following differential equation:

$$\Delta\tau = -\iota\tau\Delta E$$

wherein $\Delta\tau$: decrease in the lifetime, sec.;

$\tau$: duration of the electric field E, influence on the frame insulation, sec.;

E: electric field magnitude, kV/mm;

$\Delta E$: decrease in the electric strength with time under the influence of the electric field E;

$\iota$: constant characterizing various types of insulation. Upon solving the equation, the following expression for the insulation lifetime is obtained;

$$E = A - n\lg\tau$$

wherein

E: electric field in the frame insulation, kV/mm;

A: electric strength of the frame insulation at $$\tau = 1 \text{ sec.};$$

$\tau$: time during which the insulation withstands the electric field E, sec.;

$n = 1/\iota$: constant characterizing different types of insulation;

n is determined by a tangent of the angle between the life-time curve and time logarithm axis, namely:

$$n = \frac{\Delta E}{\Delta \lg\tau} = \frac{E_1 - E_2}{\lg\tau_1 - \lg\tau_1} = tg\,4$$

The formulas given above enable an objective comparative evaluation to be given to various types of frame insulation manufactured in the U.S.S.R. and abroad and to the classic micatape compound insulation (MCI).

Frame insulations made in the U.S.S.R. are exemplified hereinafter by "Sludoterm" and "Monolit".

The latter insulations are compared with frame insulations "Micadur" (BBC, Switzerland) and "Termolastik" (Westinghouse, U.S.A.).

The comparative evaluation is performed with respect to the A value of the electric strength at $\tau = 1$ sec., "n"-tangent of the angle between the lifetime curve and the time logarithm axis, as well as with respect to a permissible value of the electric field as calculated for 20 years of the insulation service life.

Data for micatape compound insulation, Micadur, Thermalastic, Sludoterm, and Monolit are obtained from the manufacturers' prospectuses. Data for the electroinsulating material of the present invention are given according to the results obtained from the tests of the models mentioned above.

| Insulation type | "A" | "n" | Permissible E for 20 years service life |
|---|---|---|---|
| Micatape compound insulation | 17 | 1.67 | 2.2 |
| Sludoterm (LEO Electrosila), USSR | 19 | 1.81 | 3.0 |
| Monolit (Uralelectrotiazhmash), USSR | 28 | 2.5 | 6.0 |
| Micadur (BBC), Switzerland | 30 | 2.64 | 6.6 |
| Thermalastic (Westinhouse), USA | 28 | 2.5 | 6.0 |
| Novel insulation of the present invention, "Elastonit" (VNIIelectromash), USSR | 40 | 3.3 | 13.3 |

Dielectric characteristics demonstrating specific volume resistance, electric strength, dielectric loss angle, water-resistance and moisture resistance, incombustibility, and elasticity of the electroinsulating material of the present invention have already been given.

The novel electroinsulating material "Elastonit" of the present invention based on polyethyleneterephthalate films is superior, as to the service life within the range of residence time at 50 cycles of AC of from 1 second to 2000 hours (from lg $\tau=0$ to lg $\tau=7$), over the following frame insulations: Sludoterm, Monolit, Micadur, and Thermalastic. The per-missible electric field gradient for the novel insulation "Elastonit" of the present invention, as calculated for a 20 years' service time, is higher than even those of Monolit, Micadur, Thermalastic by more than 2 times. An essential advantage of the novel insulation according to the present invention is its good processability. This insulation makes it possible to avoid the use of great amounts of toxic epoxy or polyester compounds and complicated process apparatus for impregnation under pressure. Application of the novel insulation "Elastonit" of the present invention in electrical engineering permits considerable reduction of frame insulation thickness, improves operating performances, and, first of all, reduces an electric machine's weight per unit of nominal power.

Examples illustrating proportions of the components in the electroinsulating material of the present invention are given below.

EXAMPLE 1

An electroinsulating material containing 20% by weight of a copolymer of trifluorochloroethylene with vinylidene fluoride, 10% by weight of an epoxy diane resin with a molecular weight of 1000, 60% by weight of a mica-containing material, viz. micanite 0.1% by weight of dicumyl peroxide, and 9.9% by weight of white black/zinc oxide (in the ratio of 1:1) is dissolved in acetone, and applied, by casting, as a calibrated layer onto a polyethyleneterephthalate film of 20 mcm thickness to a thickness of 100 mcm±10 mcm and then heated within a temperature range of from 80° to 200° C.

Thus material thus produced has the following physico-mechanical and dielectric properties:

| | |
|---|---|
| Specific gravity, g/cm$^3$ | 1.8–1.9 |
| Heat-resistance - at least of the "F" class | (155° C.) |
| Tensile strength of a 15 mm wide tape, kg | 15–20 |
| Electric strength, kV/mm: | |
| in the initial state | 70–80 |
| after heating at 200° C. for 24 hours, inflection, and rolling with a 2 kg roller | 60–70 |
| after treatment with a humid atmosphere (95 ± 3% relative humidity), at least | 30–40 |

Corona resistance of frame high-voltage insulation is 2–3 times higher than that of conventional mica-containing insulations:

| | |
|---|---|
| Specific volume resistance, ohm.cm.: | |
| in the initial state | $10^{15}$ |
| after heating at 200° C. | $10^{15}$ |
| after keeping in a humid atmosphere for 5 days | $10^{13}$ |
| Dielectric loss angle, %: | |
| in the initial state | 1 |
| after heating at 200° C. for 24 hours | 1 |
| after keeping in a humid atmosphere for 5 days | 3. |

EXAMPLE 2

An electroinsulating material containing 87% by weight of a copolymer of hexafluoropropylene with vinylidene fluoride, 1% by weight of polymethylphenylvinylhydrosiloxane resin, 10% by weight of a mica-containing material, viz. micaplast, 1% by weight of benzoyl peroxide, and 1% by weight of talc is dissolved in methyl ethyl ketone; from this solution an insulation is applied onto a polyimide film of 40 mcm thickness to the thickness of 120±10 mcm by dipping, which is then heat-treated.

The resulting material has physico-mechanical and dielectric properties similar to those of Example 1, except for its heat-resistance which in this Example is at least of the "H" class (180° C.).

EXAMPLE 3

An electroinsulating material containing 38% by weight of a ternary copolymer of hexafluoropropylene with vinylidene fluoride and tetrafluoroethylene, 3% by weight of indene-coumarone resin, 38% of a mica-containing material, viz. micanite, 0.1% by weight of hexamethylenediamine, and 20.9% by weight of chalk, zinc oxide, talc (in the ratio of 1:1:1) is dissolvved in a mixture of acetone and methylethyl ketone (in the ratio of 1:1) and then applied onto a glass fabric 60 mcm thick pre-treated with a varnish of the following composition (parts by weight)

| | |
|---|---|
| divinyl rubber | 100 |
| escapone resin of the divinyl oligomers type | 100 |
| linseed oil factice | 10 |
| lead rosinate | 6 |
| phenyl-$\beta$-naphthylamine | 6 |
| kerosene | 400; |

This varnish is preheated at a temperature of from 150° to 250° C. to the thickness of 100 mcm.

This solution of the electroinsulating material is applied onto said glass fabric by casting to the thickness of 200 mcm±10 mcm and then heated at a temperature of from 80° to 250° C.

The material thus produced has the following physico-mechanical and dielectric properties:

| | |
|---|---|
| Specific gravity, g/cm$^3$ | 1.8–1.9 |
| Heat-resistance - at least of the "B" class | (130° C.) |
| Tensile strength of a 15 mm wide tape, kg | 25–30 |
| Electric strength, kV/mm: | |
| in the initial state | 50–60 |
| after heating at 180° C. for 24 hours, inflection and rolling with a 2 kg roll | 40–50 |
| after keeping in a humid atmosphere (at 95±3% relative humidity) | at least 30 |
| Corona-resistance of frame high-voltage insulation is 2 times as high as that of conventional mica-containing materials; | |
| Specific volume resistance, ohm.cm.: | |
| in the initial state | $10^{15}$ |
| after heating at 180° C. | $10^{15}$ |
| after keeping in a humid atmosphere for 5 days | $10^{13}$; |
| Dielectric loss angle, %: | |
| in the initial state | below 1 |
| after heating at 180° C. for 24 hours | 1 |
| after keeping in a humid atmosphere for 5 days | 2. |

EXAMPLE 4

An electroinsulating material containing 30% by weight of a copolymer of trifluorochloroethylene with vinylidene fluoride, 3% by weight of urethane resin, 0.1% by weight of bis-(furfurylidene)-hexamethylenediimine, 30% by weight of divinylstyrene carboxylate rubber, 36% by weight of a mica-containing material and 0.9% by weight of talc is dissolved in acetone and then applied onto a glass fabric 60 mcm thick pretreated with the varnish of Example 3.

Said solution of the electroinsulating material is applied onto said glass fabric by casting to the thickness of 200±10 mcm and then heated within a temperature range of from 80° to 250° C.

The resulting material has physico-mechanical and dielectric properties somewhat better than those of the material of Example 3; in addition, the material of this Example features more pronounced thermosetting properties.

What is claimed is:

1. An electroinsulating material consisting essentially of, in percent by weight,

| | |
|---|---|
| fluorine rubber | 20–87 |
| resin | 1–10 |
| synthetic rubber | 0–30 |
| cross-linking agent | 0.1–10 |
| mica | 10–60 |
| filler | at least 0.9 and representing the balance |

wherein said fluorine rubber is a copolymer of vinylidene fluoride; said resin is a low molecular weight sticky resin selected from the group consisting of epoxy resins based on diphenylolpropane, urea-formaldehyde resins, phenol-formaldehyde resins, aminophenol resins, melamine-formaldehyde resins, urethane resins, xylenol resins, coumarone resins and indene-coumarone resins; said cross-linking agent is a cross-linking agent for said fluorine rubber; the mica consists of particles having a thickness of 1–10 microns;

and said filler is a mineral filler which acts as a distribution agent for said mica.

2. An electroinsulating material as claimed in claim 1 wherein said mica is muscovite or phlogopite.

3. A composite formed by dissolving the electroinsulating material of claim 1 in a solvent and applying said material onto a base as a calibrated layer.

4. An electroinsulating material as claimed in claim 1 wherein said sticky resin is an epoxy resin based on diphenylolpropane with a molecular weight not exceeding 1000 and is present in an amount of 10% by weight, and said cross-linking agent is dicumyl peroxide.

5. An electroinsulating material as claimed in claim 3 wherein said base is a film of polyethylene terephthalate.

6. An electroinsulating material as claimed in claim 5 wherein said fluorine rubber is a copolymer of vinylidene fluoride and trifluorochlorethylene.

7. An electroinsulating material as claimed in claim 6 wherein said resin is an epoxy resin based on diphenylolpropane.

8. An electroinsulating material as claimed in claim 7 wherein said resin has a molecular weight not exceeding 1000 and is present in an amount of 10% by weight and said cross-linking agent is dicymyl peroxide.

* * * * *